US008053009B2

(12) United States Patent
Bourguignon et al.

(10) Patent No.: US 8,053,009 B2
(45) Date of Patent: Nov. 8, 2011

(54) ONE PEICE SQUEEZABLE CONTAINER

(75) Inventors: Michel A. L. Bourguignon, Lasson (FR); Cyrille Durand, Vittel (FR); Emmanuel S. F. Laine, Caen (FR)

(73) Assignee: Nestec S.A., Vevey (CH)

( * ) Notice: Subject to any disclaimer, the term of this patent is extended or adjusted under 35 U.S.C. 154(b) by 1154 days.

(21) Appl. No.: 11/571,649

(22) PCT Filed: Jul. 14, 2005

(86) PCT No.: PCT/EP2005/007658

§ 371 (c)(1),
(2), (4) Date: Jan. 4, 2007

(87) PCT Pub. No.: WO2006/005615

PCT Pub. Date: Jan. 19, 2006

(65) Prior Publication Data

US 2008/0093248 A1 Apr. 24, 2008

(30) Foreign Application Priority Data

Jul. 14, 2004 (EP) ..... 04016518

(51) Int. Cl.
*B65D 1/02* (2006.01)
*B65D 85/72* (2006.01)

(52) U.S. Cl. ..... 426/106; 206/457; 215/371; 220/62.13; 220/62.14; 222/212; 426/104; 428/34.1

(58) Field of Classification Search ..... 426/106, 426/104; 215/371; 222/212; 206/457; 220/62.13, 220/62.14; 428/34.1
See application file for complete search history.

(56) References Cited

U.S. PATENT DOCUMENTS

| | | | | |
|---|---|---|---|---|
| 2,948,305 | A | 8/1960 | Savides | |
| 5,011,648 | A * | 4/1991 | Garver et al. | 264/521 |
| 5,638,982 | A | 6/1997 | Spector | |
| 2004/0031818 | A1 * | 2/2004 | Killoran et al. | 222/212 |

FOREIGN PATENT DOCUMENTS

| | | |
|---|---|---|
| DE | 29716172 | 10/1997 |
| EP | 1527999 A1 * | 5/2005 |
| EP | 1433804 | 4/2007 |
| WO | WO 03/008293 | 1/2003 |

* cited by examiner

*Primary Examiner* — Brent O'Hern
(74) *Attorney, Agent, or Firm* — K&L Gates LLP

(57) ABSTRACT

The present invention concerns a one piece squeezable container for chilled or frozen products comprising a body formed by a wall and closing means, said body having in his greater section a dimension d1 and a neck with an internal diameter d2, a wall thickness comprised between 30 and 500 pm, being made from a semicrystalline PET and wherein the ratio volume of the body of the container per gram of PET of the body is comprised between 20 and 100.

10 Claims, 1 Drawing Sheet

ONE PEICE SQUEEZABLE CONTAINER

Figure 1:
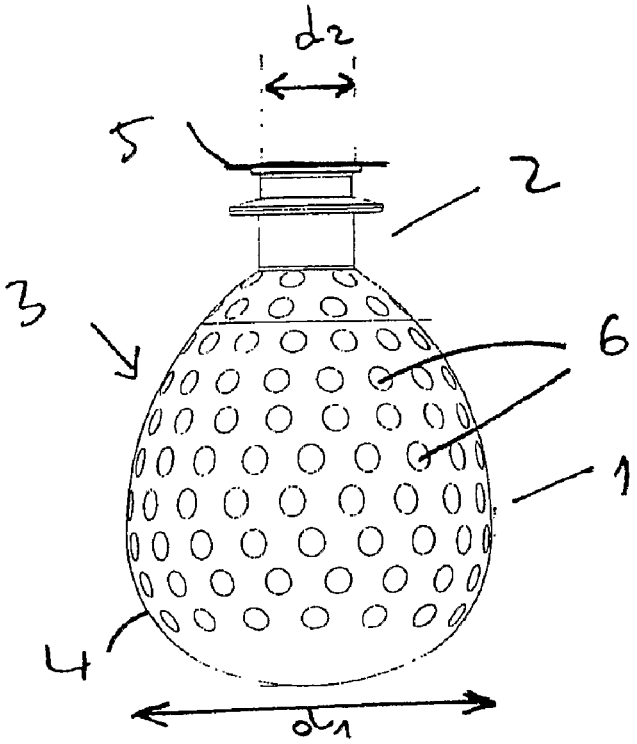

The present invention concerns a one piece squeezable container for chilled and frozen products, wherein the consumption of said product is made without the help of any spoon.

It is already known on the market packaging which have flexible bags, that may be squeezed for the consumption of the product contained therein. The problem of such type of container, particularly used for apple compote, is that the packaging per se comprises a bag with one or two bellows and at the exit side a fitment with a capping system, which is fully part of the packaging and welded on the neck of it. This type of container comprises two parts, which have to be sealed together. This is a drawback, because of the fact, that the production price is higher, first because of the two pieces and secondly, because of the more complicated line of production of said container.

The object of the present invention is to have a squeezable container, which comprises only one piece. The container of the invention is specifically useful for chilled and frozen products from liquid to pasty texture, but can also be used for dispensing any pasty cream, like in the cosmetic area.

The present invention concerns a one piece squeezable container for chilled or frozen products comprising a body formed by a wall and closing means, said body having in his greater section a dimension d1 and a neck with an internal diameter d2, a wall thickness comprised between 30 and 500 μm, being made from a semi-crystalline PET and wherein the ratio volume of the body of the container per gram of PET of the body is comprised between 20 and 100. This volume is given in ml.

The above mentioned ratio means that, according to the invention, it is possible to fill between 20 and 100 ml of product per gram of PET. Under body, we understand the container without the neck. Concerning the ratio weight of the walls on weight of the bottom, for bottles on the market, like a 150 cl bottle, the ratio is 31.5 g:10.5 g (3), for a 50 cl bottle, the ratio is 12.2:3.3 (3.5) and finally for a 1 l bottle, the ratio is 25.70:6.80 (3.78).

Semi-crystalline PET means in the present specification a PET having a crystallinity comprised between 10 and 60%. More preferably, the crystallinity is comprised between 20 and 40%.

The plastic used to form the wall or walls is PET (polyethylene terephthalate). It has been noted that the drawing of the PET has no negative influence on the water barrier properties of the obtained container and that also a thickness of around 30 μm and less guarantees a good safety of the container itself and of the storage while keeping an excellent squeezability.

In order to guarantee both the flexibility needed for the aforementioned deformation and sufficient mechanical strength, the container according to the invention is further characterized in that the thickness of the wall forming the body of the container is between 30 μm and 500 μm, preferably between 50 μm and 200 μm, depending on foreseen products. The thickness of the wall depends on the viscosity of the product to be packed. In the case of pasty products, the thickness is preferably in the range of 30 to 100 μm and in the case of liquids, the thickness is more preferably in the range of 300 to 500 μm.

As already mentioned, small thicker areas or portions of walls may also be provided on the body of the said container, particularly in close proximity to the neck and/or the bottom, so as to reinforce these parts locally and allow a good consumption means. Such reinforcements may in particular be useful to facilitate the filling of the said containers or to increase their stability during storage.

When containers of very lower volumes are used, for example of the order of 0.6 cl, the quantity of plastic material is of the order of 1.5-2.5 g. This type of container supports a vertical loading of more than about 100 kg. That the container supports a vertical or transverse loading means that the weight given does not deteriorate the package integrity, that is does not lead to a risk of breaking said container.

The container has an ovoid or substantially ovoid overall shape which is designed to optimise the consumption by the consumer through the squeezability with fingers pressure or the sucking of the product. This technology also allows any kind of shapes with non straight sides considering significant different dimensions for the top or the bottom. As a preliminary design, strawberry shapes with narrow and or reverse shape were equally obtained in terms of packaging.

According to the invention, as a preference, the body of the container has substantially the form of the fruit or the vegetable it is representing. The use of colored plastic reinforces significantly the fruit aspect and similarity.

In a particularly advantageous manner, the container according to the invention has a circular or substantially circular cross diameter.

The container according to the invention may be characterized in that the body has a bottom exhibiting a planar or roughly planar part. This part may be produced using all the methods habitually encountered in the field of the manufacture of synthetic containers (flat bottom with or without reinforcing ribs, petaloid bottom, etc.).

According to one embodiment, the container may have feet at the bottom, which are integral with said body. The presence of three feet is a good solution for packaging standing up when filled with products and closed but should be designed to allow a good squeezability when opened.

In a preferred feature of the invention, the ratio d2 on d1 is comprised between 1:3 and 1:10.

The chilled product is taken from the group consisting of milk-based product, fruit-based product and vegetable-based product. More specifically, the chilled product is taken from the group consisting of yoghurt, fresh cheese, cream dessert, fruit compote, jam and any other pasty or semi-liquid product.

The frozen product is taken from the group consisting of ice-cream, frozen vegetable, frozen fruit compote, frozen fruit puree and any other frozen product.

According to another feature, it is also possible to package any type of product in the cosmetic or perfume area.

The volume of the container is not critical. In a preferred embodiment of the invention, the body of the container has a volume comprised between 5 and 250 ml.

The objective of the invention is to have a container, which is easily squeezable, so that the consumer can consider eating the product inside, without any spoon, and everywhere and at any time in the day:on the go consumption. The product in the container has preferably a viscosity comprised between 2000 and 50000 centipoises. Although the container per se has thin wall, when it is closed with the product inside, it has a high resistance to vertical and/or transverse loads allowing good resistance to transportation.

According to a feature of the invention, the container comprises embossments simulating fruit achenes. These embossments can be also there to put the brand or the Company logo.

The means of closing are either a cap, or sealed membrane. Both means are especially adapted to their consumption by the consumer as they allow the hygienic protection of the area where consumer will place his lips. The caps can be used for any diameter of opening of the neck and therefore allow products with high pieces (from pulp to fruit pieces below 25 mm). The sealed membranes are preferred with smaller diameter of the neck, for example in the area of 10 mm in order to avoid any cap swallowing by children.

The way of producing the container according to the invention is stretch blow molding.

In this case, the body is obtained by blow moulding of a PET preform with high stretch index in comparison with the classical stretching of a preform. Compared with the blowing of plastic bottles, wherein the blowing pressure is comprised between 30 and 40 bar, according to the process of the invention, it is sufficient to blow at a pressure of around 3 or 4 times less. This reduces the cost of the process and also of the machine which is used. Concerning the stretch index, it is depending of the volume of the final container. For example, in the case of a container having a volume of less than 100 cl, the stretch index is between 100 and 300 cm. In the case of a container having a volume of 500 to 1000 cl, the stretch index is comprised between 500 and 700 cm. In the case of container having volume of 2000 cl or more, the stretch index is around and more than 1000 cm.

Figure 2:
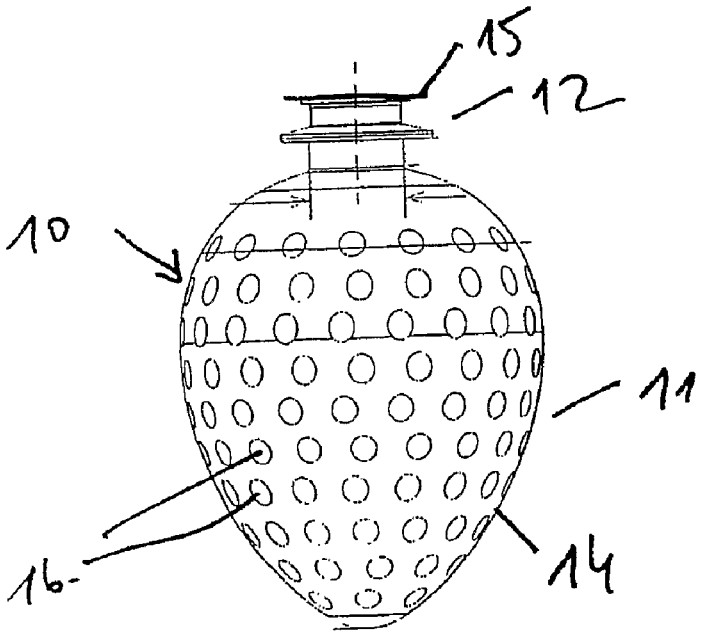

Other features and advantages of the invention will become apparent from the description which follows, given by way of example and with reference to the appended drawings in which:

FIG. 1 is a schematic view in side elevation and in diameter of one embodiment of the container of the invention and FIG. 2 is a schematic view in side elevation and in diameter of a second embodiment of the container of the invention.

In the first embodiment described and depicted, the container 3 for a chilled dairy product, like a yoghurt, essentially consists of a body 1 and one neck 2, with a form of a strawberry. In this present case, the container is filled with a strawberry yoghurt. The wall 4 of the container has a thickness of 70 microns and is made from PET. The closure of the container is a membrane 5. The volume of the container is of 60 ml. In the present case, the ratio d2 internal diameter of the neck on d1 diameter on the greater section is 1:4.5. The outside of the container presents embossments 6 simulating the achenes from the strawberry. This container has a very good squeezability and allows a good emptying of the pasty product. It is very convenient to use.

The second embodiment is also a strawberry like the FIG. 1, but in the reverse shape. The container 10 for a chilled dairy product, like a yoghurt, essentially consists of a body 11 and one neck 12, with a form of a strawberry. In this present case, the container is filled with a strawberry yoghurt. The wall 14 of the container has a thickness of 70 microns and is made from PET. The closure of the container is a membrane 15. The volume of the container is of 60 ml. In the present case, the ratio d2 internal diameter of the neck on d1 diameter on the greater section is 1:4.5. The outside of the container presents embossments 16 simulating the achenes from the strawberry. This container has a very good squeezability and allows a good emptying of the product. It is very convenient to use.

The invention claimed is:

1. A one piece squeezable container for housing a consumable product comprising a body formed by a wall, the body having at a largest section a dimension d1 and a neck with an internal diameter d2, a wall thickness of between 300 and 500 μm, the body being made from a semi-crystalline polyethylene terephthalate and the ratio volume of the body of the container per gram of polyethylene terephthalate of the body is between 20 and 100, the container further comprising a plurality of embossments on an exterior of the container.

2. A container according to claim 1, wherein the body has a form that is substantially the form of a fruit or a vegetable.

3. A container according to claim 1, wherein the ratio d2 to d1 is between 1:3 and 1:10.

4. A container according to claim 1, wherein the container contains a chilled product selected from the group consisting of milk-based product, fruit-based product and vegetable-based product.

5. A container according to claim 1, wherein the container contains chilled product selected from the group consisting of yoghurt, fresh cheese, cream dessert, fruit compote, and jam.

6. A container according to claim 1, wherein the container contains a frozen product selected from the group consisting of ice-cream, frozen vegetable, frozen fruit compote, and frozen fruit puree.

7. A container according to claim 1, wherein the body has a volume of 5 to 250 ml.

8. A container according to claim 1, wherein the container includes a product having a viscosity of between 2000 and 50000 centiPoise.

9. A container for housing a consumable product comprising a body formed by a wall, having a thickness of between 300 and 500 μm, the body being made from a semi-crystalline polyethylene terephthalate and the ratio volume of the body of the container per gram of polyethylene terephthalate of the body is between 20 and 100, the container further comprising a plurality of embossments on an exterior of the container.

10. A one piece squeezable container for chilled or frozen products comprising a body formed by a wall having a wall thickness between 300 and 500 μm, the body being made from a semi-crystalline polyethylene terephthalate and the ratio volume of the body of the container per gram of polyethylene terephthalate of the body is between 20 and 100, the container further comprising a plurality of embossments on an exterior of the container.

* * * * *